US005503443A

United States Patent [19]

Tautfest

[11] Patent Number: 5,503,443

[45] Date of Patent: Apr. 2, 1996

[54] COMPACTABLE DOOR BLOCKING DEVICE

[76] Inventor: Michael Tautfest, 9545 Samoline Ave., Downey, Calif. 90240

[21] Appl. No.: 491,408

[22] Filed: Jun. 16, 1995

[51] Int. Cl.[6] ..... E05C 17/54

[52] U.S. Cl. ..... 292/339; 292/DIG. 15

[58] Field of Search ..... 292/339, 338, 292/288, DIG. 15

[56] References Cited

U.S. PATENT DOCUMENTS

| | | | |
|---|---|---|---|
| 197,187 | 11/1877 | Voege . | |
| 1,064,320 | 6/1913 | Glindkamp . | |
| 3,731,341 | 5/1973 | Woodruff | 292/DIG. 15 X |
| 4,421,348 | 12/1983 | Kahn | 292/339 |
| 4,676,536 | 6/1987 | Arbic et al. | 292/339 |
| 5,131,701 | 7/1992 | Stepniewski | 292/339 |
| 5,207,464 | 5/1993 | Reeves | 292/339 |

FOREIGN PATENT DOCUMENTS

| | | | |
|---|---|---|---|
| 670588 | 11/1929 | France | 292/288 |
| 2188676 | 10/1987 | United Kingdom | 292/338 |

*Primary Examiner*—Rodney M. Lindsey
*Attorney, Agent, or Firm*—Lyon & Lyon

[57] ABSTRACT

An adjustable and compactable door blocking device for preventing unauthorized entry through a door. In a preferred embodiment, the door blocking device comprises three adjustable members which form a triangular brace for counterpoising forces between the face of the door, the floor and the door bottom when in use, and which can be adjusted to a compact position for travel and storage, a latch means for installation of the device and application of optimal bracing force, and a pressure measuring tube for measuring blocking force and determining proper installation of the device.

12 Claims, 3 Drawing Sheets

COMPACTABLE DOOR BLOCKING DEVICE

BACKGROUND OF THE INVENTION

1. Field of the Invention

The present invention relates to a door blocking device and more particularly to a compactable door blocking device which can be adjustably mounted between the door and the floor.

2. Description of the Related Art

Personal security at home or while travelling often requires additional measures to secure doors from unauthorized entry. Prior door blocking devices have been relatively large, bulky devices, not suitable for convenient travel or storage. These prior devices do not provide sufficient bracing force and are relatively easily displaced once installed through repeated attempted entry or vibration of the door. Prior devices also do not provide feedback to the user regarding whether the device has been properly installed.

Accordingly, there is a need for a light weight, adjustable door blocking device which provides the blocking force of much larger devices, can be easily installed and removed, provides feedback to the user to ensure proper installation, cannot easily be displaced by repeated unauthorized attempts at entry or vibration of the door and is compactable for convenient transportation or storage.

SUMMARY OF INVENTION

The present invention is directed to a compactable and adjustable door blocking device for preventing unauthorized entry through a door.

In a first, separate aspect of the present invention, the door blocking device utilizes three adjustable members which form a triangular brace for counterpoising forces between the face of the door, the floor and the door bottom.

In a second, separate aspect of the present invention, there is a lever arm for providing heightened blocking force during installation of the device.

In a third, separate aspect of the present invention, the device is compactable for easy storage and travel.

In a fourth, separate aspect of the present invention, there is a pressure sensitive meter for measuring the applied blocking force between the door and floor and for determining proper installation of the device.

Accordingly, it is an object of the present invention to provide an improved door blocking device. Other objects and advantages of the invention will become apparent to those skilled in the art upon review of the following drawings, the description of the preferred embodiment and the appended claims.

BRIEF DESCRIPTION OF THE PREFERRED EMBODIMENT

Figure 1:
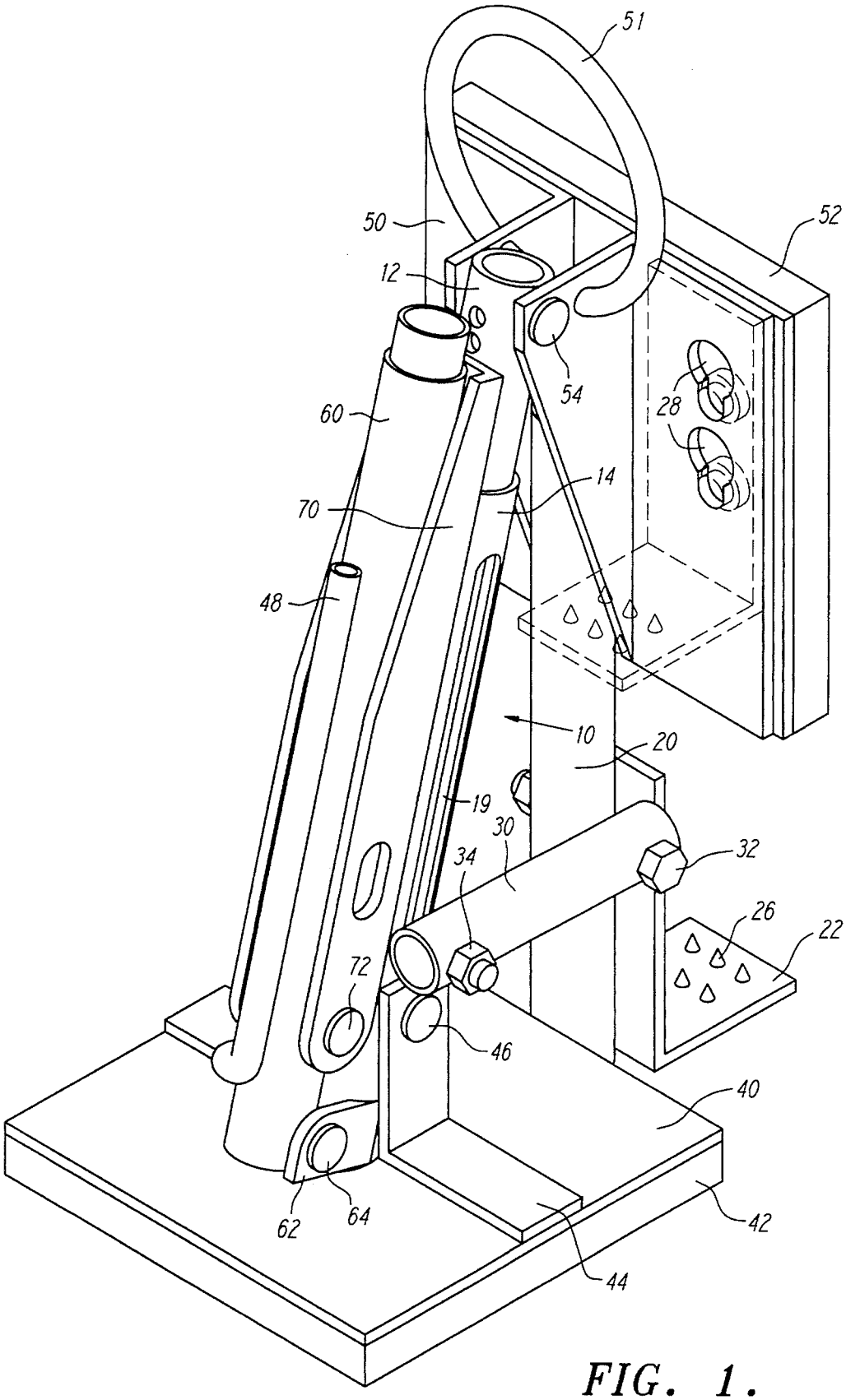
FIG. 1 is a perspective view of a door blocking device according to the present invention.
Figure 2:
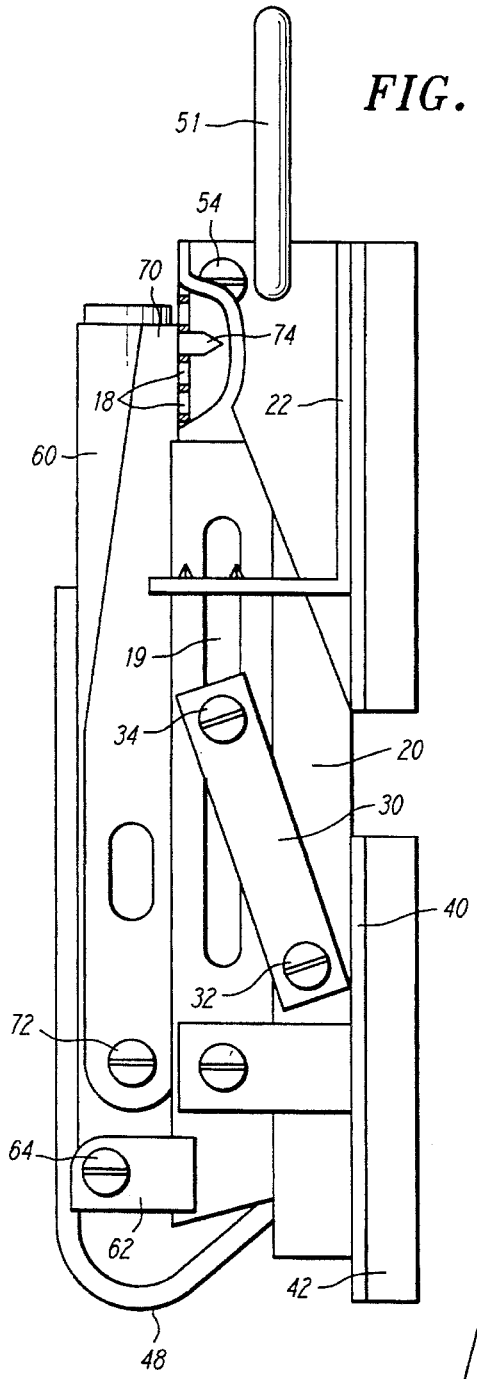
FIG. 2 is a side view of the door blocking device in a compact position.
Figure 3:
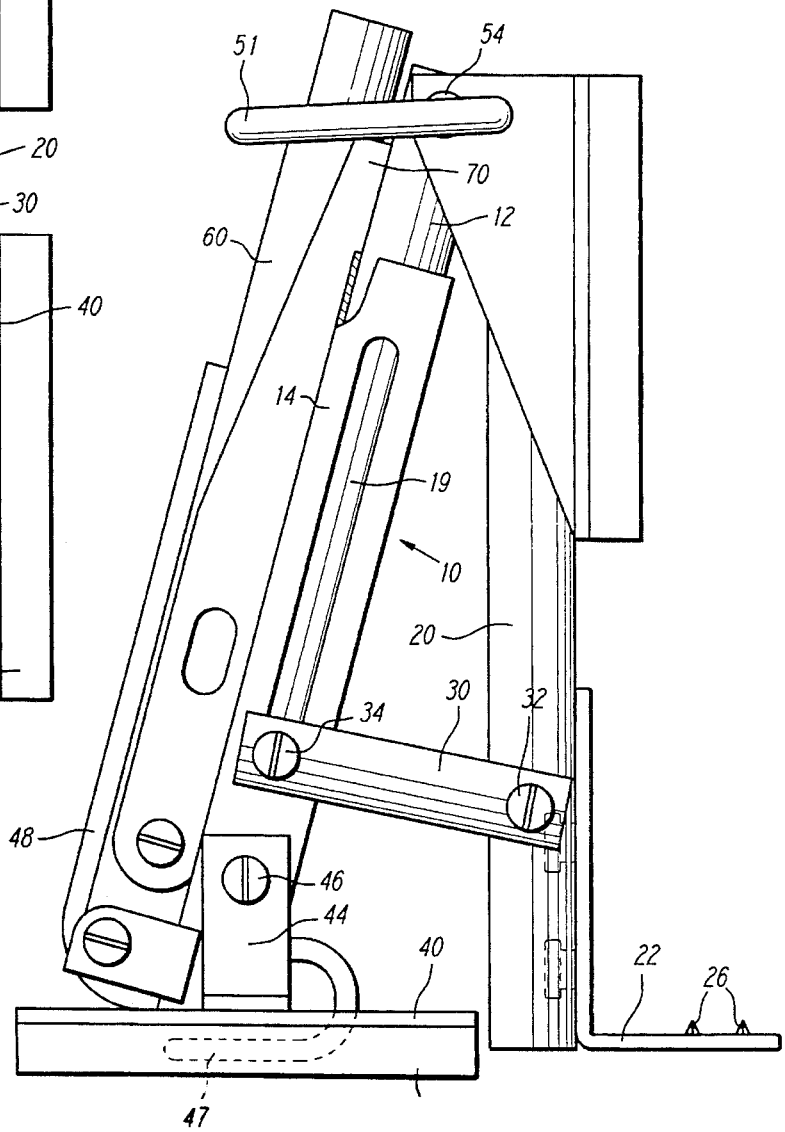
FIG. 3 is a side view of the door blocking device in an installed position.

Referring now to FIGS. 1–3, the door blocking device according to the present invention is preferably comprised of an adjustable brace member 10, which may be attached at its upper end to a vertical member 20. Both the brace member 10 and the vertical member 20 may be coupled at or near their base to a horizontal member 30 which helps align both the brace member 10 and vertical member 20 for proper installation. The horizontal member 30 also helps to prevent slippage of the lower portion of the brace member 10 away from the door bottom during installation and use.

The brace member 10 is preferably attached to a floor plate 40 at its lower end, and to a door plate 50 at its upper end. The door plate 50 is preferably attached to both the brace member 10 and vertical member 20. The attachment of door plate 50 to the vertical member 20 may be achieved by welding or through the use of one or more door pad bolts (not shown). The door plate 50 may be rotatably attached to brace member 10 through the use of a brace member bolt 54, such bolt acting as a pivot point for brace member 10 and vertical member 20. Door pad 52 is attached to door plate 50, and is preferably made of a non-skid substance such as foam rubber for contacting and gripping the door. In alternative embodiments, the door pad may be made of other suitable gripping materials such as other synthetic or natural rubbers, plastic materials or adhesives.

Figure 4:
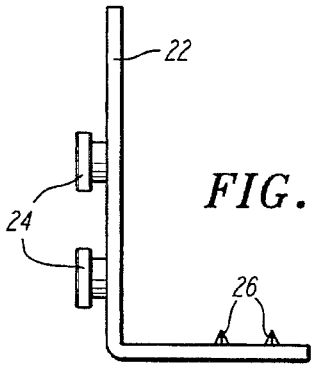
FIG. 4 is a side view of the door flange.

At the base of the vertical member 20 is a door flange 22 which may be fixedly attached through the use of one or more door flange hooks 24. In another embodiment, the door flange 22, through the use of flange hooks 24 (shown in FIG. 4) may also be removable to the door plate 50 for storage in the compact position through the use of flange storage holes 28. The door flange 22 also preferably contains flange teeth 26 or a similar gripping device or surface which provides a gripping means between the door flange 22 and the door bottom. The flange teeth 26, along with the horizontal member 30, help to prevent slippage of the door flange 22 from under the door during installation and use.

A floor pad 42 is preferably attached to floor plate 40, which may be comprised of a dense foam rubber or another suitable non-skid and protective material such as synthetic or natural rubbers, plastic materials or adhesives. Such a non-skid material helps to prevent slippage of the floor pad on most floor surfaces including carpet, tile, marble and linoleum. The door plate 50 may be attached to door pad 52, which may also be comprised of a suitable non-skid and protective material such as a dense foam rubber which helps to prevent slippage of the door pad while installed against the door.

The brace member 10 may be comprised of two or more telescoping tubular members such as an inner tubular member 12 and an outer tubular member 14. The outer tubular member 14 is preferably attached to floor plate 40 through the use of one or more floor brackets 44 and corresponding floor bracket bolts 46, which allow the floor plate 40 to adjustably rotate at the bottom end of the brace member 10. The floor bracket bolts 46 allow the floor plate 40 and the floor pad 42 to properly align with the floor during use, or to rotate to a position adjacent the vertical member 20 when the device is in the compact position (as shown in FIG. 2). Outer tubular 14 of the brace member 10 may be cut at an angle which provides a flush contact between lower end of the brace member 10 and floor plate 40 to help achieve proper alignment during installation of the device. A preferable angle between the brace member 10 and the floor for optimal performance of the device on the smoothest of floor surfaces has been determined through experimentation to be approximately 75°. In alternative embodiments, the brace member 10 may be comprised of a screw type mechanically a hydraulic piston or jacking lever arrangement.

Also provided is a means for determining the applied force between the floor and door, in a preferred embodiment through the use of a pressure-sensitive bladder 47 and connected measuring tube 48. As the device is installed, pressure against the bladder 47 causes a liquid or other suitable substance such as a gas to leave the bladder 47 and travel through the translucent measuring tube 48 to register the applied force. This force against the floor is also a direct indication of the force holding the door in place and can likewise be used to determine if the device has been properly installed.

An extendable lever 60 is preferably rotatably attached at its base to the base of the brace member 10 through the use of a lever bracket 62 and a lever bolt 64. A latch tongue 70 may be rotatably attached at its base with the base of the lever 60, and adjacent the lever bracket 62, through the use of a latch tongue bolt 72. The latch tongue 70 is preferably slidably attached to the lever 60 to allow for a range of distances for the latch tongue 70 to travel during installation. For example, during installation of the device on a soft surface, such as carpet, the lever 60 must cause the latch tongue 70 to travel a greater distance during proper installation. A groove 61 in the lever 60 for the latch tongue 70 to movable slide in is shown more clearly in FIGS. 5C–5E.

The upper end of the latch tongue 70 may contain a latch pin 74 which, during installation of the device, aligns with one or more brace member holes 18 preferably located in the inner tubular member 12. During installation, the closure of lever 60 to a position parallel to the brace member 10 causes the latch pin 74 to advance the inner tubular member 12 upwardly and outwardly from the outer tubular member 14. This advancement of the inner tubular member 12 causes the door pad 52 to apply significant force against the door.

The horizontal member 30 may be rotatably attached to the vertical member 20 through the use of a horizontal bolt 32. Inner tubular member 12 and outer tubular member 14 preferably contain an angular groove 19 which are aligned. The horizontal member 30 may also be fixedly attached to a sliding bolt 34 which preferably travels in the angular groove 19.

Once installed, ring 51 locks the lever 60 in place to help prevent displacement of the device through vibration. (See FIGS. 3 and 5E). Ring 51 also locks the device in place when in the compact position.

Figure 5A:
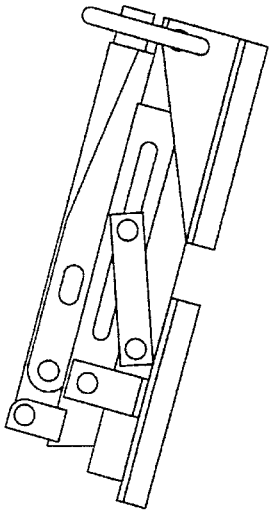
FIGS. 5A–E are a five part, side view of the door blocking device from a compact position to an installed position.
Figure 5B:
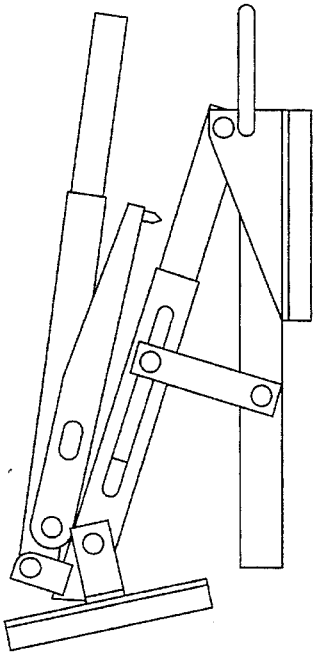
Figure 5C:
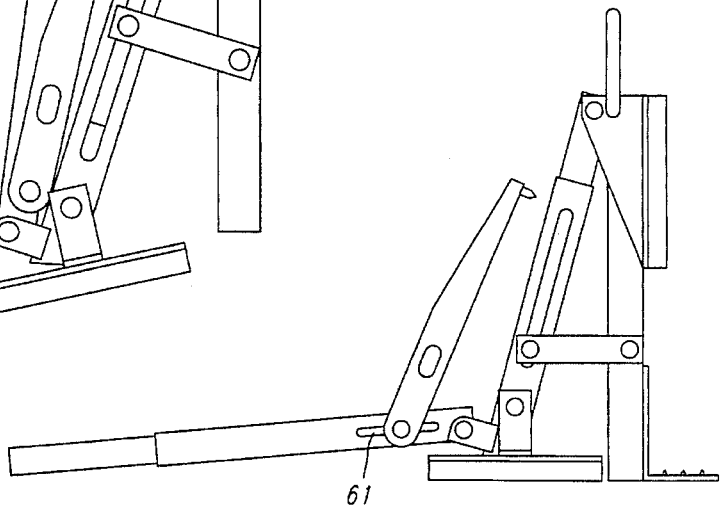
Figure 5D:
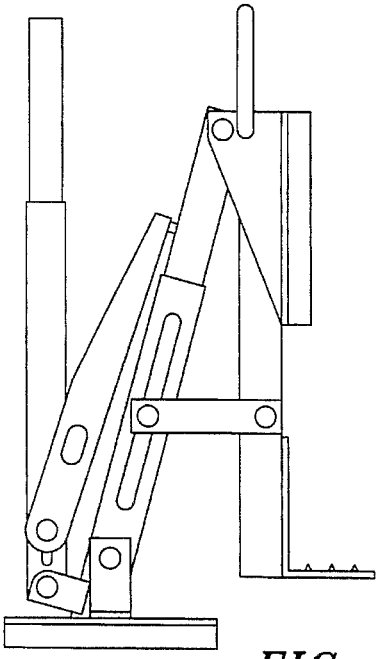
Figure 5E:
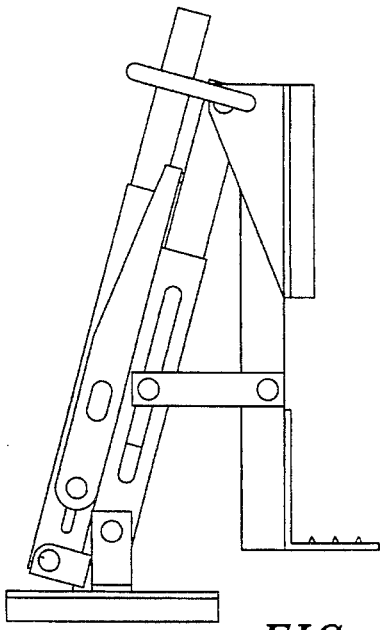

Now referring to FIGS. 5A–E, there is now shown and described use of a preferred embodiment of the device from the compact position to the installed position. FIG. 5A shows the device in a compact position. FIG. 5B shows the device in an interim position prior to being ready for installation. FIG. 5C shows the device in the fully open position ready for being installed, with the lever 60 down, the latch tongue 70 and latch pin 74 removed and the inner tubular member 12 of the bracing member 10 in a non-telescoping position inside the outer tubular member 14. FIG. 5D shows the device during installation where the latch pin 74 is engaged in a brace member hole 18, and the lever 60 is at an interim position causing the door flange 22 to rise from contacting and gripping the underside of the door. FIG. 5E shows the device in the fully installed position.

Other objects, aspects and advantages of the invention can be obtained from a view of the claims and appended figures. It is to be understood that other embodiments of the present invention can be constructed and be within the scope of the present invention.

What is claimed:

1. A door blocking device for installation between a door and floor, comprising:

a door plate;

a floor plate;

an extendable brace member having a first end and a second end, said first end attached to said floor plate and said second end movably attached to said door plate;

a vertical member having an upper end and a lower end, said upper end attached to said door plate;

a door flange attached to said lower end of said vertical member for contacting said door;

a horizontal member rotatably attached to said vertical member and slidably attached to said brace member;

a lever mechanism attached to said brace member for extending and locking said brace member, wherein actuation of said lever mechanism extends said brace member and raises said door flange to contact the underside of said door.

2. The device of claim 1, further comprising:

a latch tongue attached to said lever mechanism having a first end and a second end, said first end rotatably attached to the base of said lever mechanism;

a latch pin located at said second end of said latch tongue;

at least one hole in said brace member adapted to receive said latch pin, whereby said latch pin and said hole lock said brace member in an extended position during use of said device.

3. The device of claim 1, further comprising;

a floor pad attached to said floor plate for contacting the floor;

a bladder containing measuring substance, said bladder located within said floor pad and located between said floor plate and said floor;

a tube which communicates with said bladder for measuring the force against the bladder during use of said device.

4. The device of claim 1, further comprising a door pad attached to said door plate for contacting said door during installation of said device.

5. The device of claim 1 wherein said door flange is removable from said vertical member.

6. The device of claim 1, wherein said brace member and said horizontal member are collapsible on said vertical member for storage of said device.

7. The device of claim 1 wherein said floor plate is rotatable around an axis perpendicular to said brace member for storage of said device.

8. A compactable door blocking device for installation between a door and floor, comprising:

a door plate;

a floor plate;

an extendable brace member having a first end and a second end, said first end movably attached to said floor plate and said second end movably attached to said door plate;

a vertical member having an upper end and a lower end, said upper end attached to said door plate;

a door flange attached to said lower end of said vertical member for contacting the underside of said door;

a horizontal member rotatably attached to said vertical member and slidably attached to said brace member to form a triangular shape with said brace member and said vertical member;

a lever mechanism attached to said brace member for extending and locking said brace member during installation and use;

a groove along said brace member for slidably receiving said horizontal member wherein said brace member and said horizontal member are collapsible on said vertical member for storage of said device.

9. The device of claim 8, further comprising:

a latch tongue attached to said lever mechanism having a first end and a second end, said first end rotatable attached to the base of said lever mechanism;

a latch pin located at said second end of said latch tongue;

at least one hole in said brace member adapted to receive said latch pin, whereby said latch pin and said hole lock said brace member in an extended position during installation of said device.

10. The device of claim 8, further comprising:

a floor pad attached to said floor plate for contacting the floor;

a bladder containing measuring fluid, said bladder located within said floor pad and located between said floor plate and said floor;

a tube which communicates with said bladder for measuring the force against the bladder during use of said device.

11. The device of claim 8, further comprising a door pad attached to said door plate for contacting said door during installation of said device.

12. The device of claim 8 wherein said door flange is removable from said vertical member.

* * * * *